United States Patent [19]

Shaw et al.

[11] 4,285,193

[45] Aug. 25, 1981

[54] MINIMIZING $NO_x$ PRODUCTION IN OPERATION OF GAS TURBINE COMBUSTORS

[75] Inventors: Henry Shaw, Scotch Plains; Alvin Skopp, Clark, both of N.J.

[73] Assignee: Exxon Research & Engineering Co., Florham Park, N.J.

[21] Appl. No.: 954,187

[22] Filed: Oct. 24, 1978

Related U.S. Application Data

[60] Continuation of Ser. No. 825,030, Aug. 16, 1977, abandoned, which is a division of Ser. No. 664,621, Mar. 8, 1976, abandoned.

[51] Int. Cl.[3] ..... F02C 7/00; F02C 7/264

[52] U.S. Cl. ..... 60/39.06; 60/723; 60/732

[58] Field of Search ..... 60/39.02, 39.06, 723, 60/732; 431/7

[56] References Cited

U.S. PATENT DOCUMENTS

| | | | |
|---|---|---|---|
| 3,729,285 | 4/1973 | Schwedersky | 431/8 |
| 3,846,976 | 11/1974 | Pfefferle | 60/723 |
| 3,943,705 | 3/1976 | DeCorso et al. | 60/723 |
| 4,040,252 | 8/1977 | Mosier et al. | 60/723 |
| 4,054,407 | 10/1977 | Carrubba et al. | 60/732 |

OTHER PUBLICATIONS

Judge, A. W., *Modern Gas Turbines,* Chapman & Hall Ltd., 1947, pp. 218–220.

Hazard, H. R., *$NO_x$ Emissions from Experimental Compact Combustors,* ASME Publication No. 72-GT-108, 1972.

Yamanaka et al., *Preliminary Study of Low Emission Gas Turbine Combustor with Air Blast Atomizer,* Journal of Engineering for Power, Mar., 1975.

DeCorso et al., *Catalysts for Gas Turbine Combustors—Experimental Test Results,* Journal of Engineering for Power, Mar., 1976.

*Primary Examiner*—Louis J. Casaregola

*Attorney, Agent, or Firm*—Jerome E. Luecke; Jack Matalon

[57] ABSTRACT

A novel method for operating gas turbine combustors while minimizing the formation and discharge of pollutants such as $NO_x$ is described. In one embodiment, the use of more than one catalyst in series is employed to effect fuel oxidation at temperatures below flame temperature, thereby minimizing $NO_x$ formation.

In another embodiment, a staged catalytic combustor is employed comprising a two zone combustion chamber involving a noncatalytic zone in which fuel is partially combusted under fuel rich conditions and combustion is completed in the second zone, utilizing catalytic oxidation with excess air to complete the combustion and minimize $NO_x$ formation.

Still another embodiment concerns the use of a novel design for the primary combustion zone by which fuel is partially burned with substoichiometric amounts of air and, thereafter, the partially burned primary zone effluent is mixed into the secondary air stream where continued combustion proceeds at a temperature below that needed for $NO_x$ production. The operation of the primary zone under fuel rich conditions minimizes $NO_x$ formation, and the novel primary combustion zone design provides good mixing of the hot, partially burned primary zone effluent into the secondary air stream.

2 Claims, 5 Drawing Figures

HYBRID CATALYTIC COMBUSTOR

Zone 1: Burn rich with less than 75% stoichiometric air ~ 3600°F.
Zone 2: Bulk of preheated air enters at 1000°F.
Zone 3: Hot primary zone effluent is mixed into air.
Zone 4: Mixture is fully diluted and cooled to about 1400°F.
Zone 5: Catalyst completes oxidation to about 1800°F.

FIGURE I

HYBRID CATALYTIC COMBUSTOR

Zone 1: Burn rich with less than 75% stoichiometric air ~ 3600°F.
Zone 2: Bulk of preheated air enters at 1000°F.
Zone 3: Hot primary zone effluent is mixed into air.
Zone 4: Mixture is fully diluted and cooled to about 1400°F.
Zone 5: Catalyst completes oxidation to about 1800°F.

$NO_x$ EQUILIBRIUM IN JET A COMBUSTION

TEST CATALYST GEOMETRY

HYBRID SYSTEM REDUCES $NO_X$

COMPARISON OF CONVENTIONAL WITH CATALYTIC GAS TURBINE COMBUSTION

MINIMIZING $NO_x$ PRODUCTION IN OPERATION OF GAS TURBINE COMBUSTORS

This application is a continuation of copending application Ser. No. 825,030, filed Aug. 16, 1977 (abandoned), which application is a divisional of copending application Ser. No. 664,621, filed Mar. 8, 1976 (abandoned).

BACKGROUND OF THE INVENTION

The need for gas turbine combustion operations which meet air pollution requirements and maximize fuel utilization is of sufficient importance to have prompted a great deal of experimentation in the area. It is known that controlled mixing of excess air in the second stage of a two stage combustion system is the key to limiting $NO_x$ formation.

In a gas turbine engine, inlet air is continuously compressed, mixed with fuel and then burned in a combustor. Quantities of air greatly in excess of stoichiometric amounts are compressed and used to keep the combustor liner cool and to dilute the combustor exhaust gases so as to avoid damage to the turbine blades and nozzle. Generally, primary sections of the combustor are operated near stoichiometric conditions which produce combustor gas temperatures up to approximately 4,000° F. Further down the combustor, secondary air is added which raises the air-fuel ratio and lowers gas temperatures so that the gases exiting the combustor are in the range of 2,000° F. The fuel injection pressure varies and it is typically 600 PSI for full power and as low as 60–100 PSI for idle conditions.

It is known that $NO_x$ formation is thermodynamically favored by high temperatures. Kinetic studies indicate that the rate of NO formation has a high activation energy (approx. 115 k cal/mole) so that the major formation of NO must take place in the high temperature primary combustion zone of conventional turbines. Since NO formation reaction is so very highly temperature dependent, decreasing peak combustion temperatures provide an effective means of reducing $NO_x$ emissions from combustion equipment. Operating the combustion in a very lean condition (i.e., high excess air) is one of the simplest ways of achieving low temperatures and consequently, low $NO_x$ emissions. The problems of very lean ignition and combustion are ones that have been encountered and solved for many automotive emission control systems and for industrial fume-solvent incineration systems. In both of these cases, catalysts are used to promote and complete the combustion process. In a similar way, catalysts can be used with gas turbines to provide efficient combustion in lean systems. This invention, therefore, relates to methods of operating gas turbine combustors while minimizing the formation and discharge of pollutants such as $NO_x$. More particularly, the invention describes the use of a series of two or more catalysts to effect fuel oxidation at temperatures below flame temperatures, which thereby will minimize $NO_x$ formation. In another embodiment of the invention, a staged catalytic combustor is operated wherein fuel is burned under fuel rich conditions in a noncatalytic zone, followed by catalytic oxidation of the partially burned fuel in a second zone in which a catalyst is employed to complete the fuel oxidation and minimize $NO_x$ and other emissions. The invention is also directed to the use of a novel primary combustion zone design in which fuel is partially burned with substoichiometric amounts of air and the partially burned primary zone effluent is thereafter mixed into the secondary air stream without continued high temperature combustion. This has the effect of both quenching the hot partially burned primary zone effluent and providing a sufficient mix of the partially burned fuel with secondary air so that complete combustion may be maintained under conditions which do not favor the formation of $NO_x$. The operation of gas turbine combustors as per the above described embodiments provides, in addition to $NO_x$ reduction, the following benefits: improved fuel efficiency and minimization of CO and unburned hydrocarbon emissions.

SUMMARY OF THE INVENTION

In accordance with the present invention, gas turbine combustors are operated with the use of two or more catalysts in series to oxidize the fuel and provide high temperature gas streams to the turbine under which the temperatures of the gas stream maintained would be lower than flame temperatures such that relatively low $NO_x$ levels would be produced. Such a catalyst system has the potential to oxidize hydrocarbons in the range of 350° F. to about 2400° F. The specific range in temperatures is related to the durability and activity properties of the catalysts and also corresponds to the modes of operation of variable speed gas turbine.

DETAILED DESCRIPTION

Figure 5:
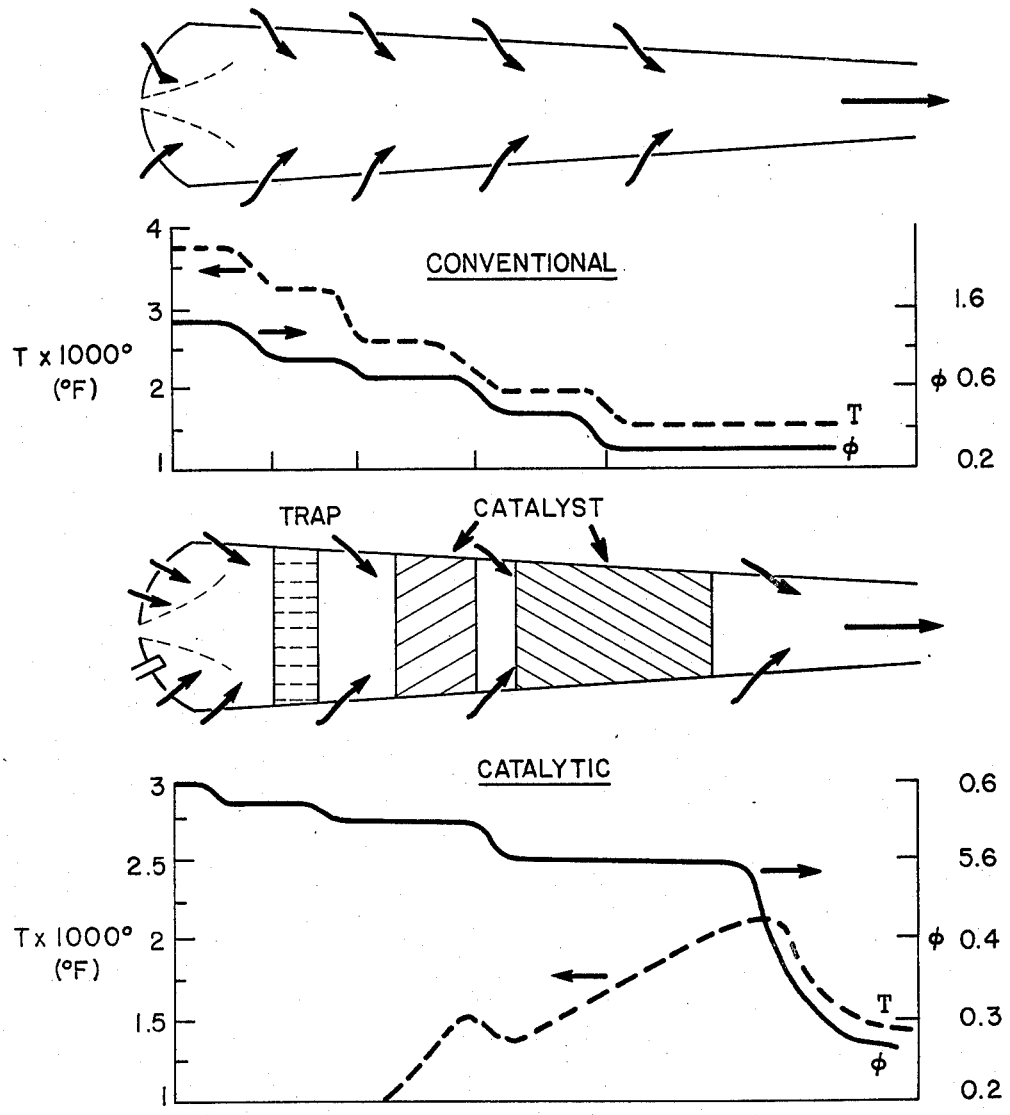
FIG. 5 graphically illustrates the comparison of a conventional gas turbine combustor with a catalytic system and illustrates the importance of the excess air levels.

As indicated previously, the present invention relates to a method wherein gas turbine combustors are operated with the use of two or more catalysts in series to oxidize the fuel and provide high temperature gas streams to the turbine under which the temperatures of the gas stream maintained would be lower than flame temperatures such that relatively low $NO_x$ levels would be produced. A comparison of flame temperatures at various air/fuel ratios in a conventional turbine and catalytic combustion temperatures at various air/fuel ratios in a catalytic turbine within the scope of this invention is shown schematically in FIG. 5. This catalytic approach employs the use of two or more catalysts in series. These catalysts include a platinum catalyst for ignition at temperatures of 350° to 1200° F. followed by a copper-nickel catalyst to help bring fuel air mixtures to about 1600° F. followed by the use of a Nichrome mesh catalyst to oxidize fuel at temperatures in excess of 1600° F. to 2400° F. Such a catalyst system has the potential to oxidize hydrocarbons in the range of 350° F. to about 2400° F. The specific range in temperatures is related to the durability and activity properties of the catalysts and also corresponds to the modes of operation of variable speed gas turbines. For example, the various modes of an aircraft gas turbine engine would vary from idle (low temperatures) through full power (high temperatures) to take-off (peak temperatures). In one of the ways of operation, a pre-mixed and preheated lean air fuel stream would be passed over a noble metal catalyst to initiate, i.e., lightoff, the lower temperature combustion of the fuel. The noble metal catalyst would be located in a thin zone upstream of the non-noble metal catalysts which would complete the combustion. This dual catalyst system would take advantage of the higher rates of reaction promoted by noble metals, e.g., platinum, at combustor inlet temperatures but would not suffer from the high temperature deactivation problems normally associated with noble metal catalysts. To avoid these problems, the volume of noble metal catalyst would be low enough to prevent its exposure to temperatures in excess of 1500° F. The use of three catalysts in series is the preferred approach, in order not to exceed the physical property limitation of the catalyst material. These catalysts used in series have been described above, and include metals selected from the group consisting of Groups IB, IIB, IIIB, IVB, VB, VIB, VIIB, and VIIIB of the Periodic Table.

In another embodiment of the present invention, a staged catalytic combustor is employed which has certain advantages over fuel lean catalytic oxidation. This embodiment involves burner operations under fuel rich conditions, mixing the effluent with air and completing the oxidation catalytically. Thus, the partially burned mixture from the primary zone which has been burned in a noncatalytic fashion would be passed through a secondary zone after the partially burned effluent is mixed into the air stream to a desired final equivalence ratio of about 0.3. The unburned primary zone effluent would be passed over an oxidation catalyst such as a nickel-copper catalyst, nickel oxide on ceramic, rare earth oxides, or Nichrome screens which would complete the fuel oxidation at the desired turbine inlet temperature to about 2000° F. Alternatively, this embodiment may be operated by mixing the partially burned stream with air over the catalyst in order to prevent an excessive temperature increase. Such an alternative is clearly within the scope of the present invention.

Another embodiment by which the present invention may be operated employs the use of a novel primary combustion zone design in which the chamber within the combustor is operated under fuel rich conditions with the amount of air between 50 and 70% of stoichiometric requirements. The rich, high temperature stream from this chamber would be mixed with additional air in the combustor to the desired final equivalence ratio to complete the combustion. A catalyst, if needed, would be employed to complete the combustion of the partially oxidized fuel and combustion species and such a catalyst would be a smaller, non-noble metal catalyst bed, since its purpose would be to promote the completion of the last 50% or less of the oxidation. The principal feature of this embodiment is the technique for mixing the hot, partially burned primary zone effluent into the secondary air stream without continued combustion. The mechanical design of the primary zone envelope is crucial to the proper operation of the hybrid combustor and such a design will be described hereinafter with reference to the figure attached to this application and made a part hereof.

The solid catalysts used in the catalytic combustor embodiment of the present invention can have various forms and compositions and can be the type used or generally known in the art to oxidize fuels in the presence of molecular oxygen. Preferably, the initial catalyst (by initial is meant the catalyst with which the fuel is first contacted) may generally comprise noble metals or mixtures of noble metals as screens or ceramic substrates. The intermediate catalyst bed may comprise materials such as transition metals, mixtures or alloys as screens or on ceramic substrates, as well as rare earth oxides on ceramic substrates. The third catalyst employed in series as per the preferred embodiment herein comprises materials generally described as transition metals or alloys as screens or on ceramic substrates, as well as rare earth oxides on ceramics. The latter are chosen for their resistance to physical property degradation at the high temperatures of the last stage.

In general, air to fuel ratios by weight in the all catalytic approach are in the range of from 500 to 30, and preferably from 150 to 30. The temperature for operating the catalytic method will be in the range of from 150° to 2800° F., preferably from 250° to 2200° F., most preferably from 350° to 2000° F. Space velocities which are useful for operating the catalytic embodiment are generally in the range of from 50,000 to 50,000,000, most preferably from 500,000 to 5,000,000 V/V/Hr.

In operating the staged catalytic combustor embodiment, the catalyst that may be employed in the second zone of the two zone system are generally materials described as transition metals, mixtures or alloys as screens or on ceramic substrates, as well as rare earths on ceramic substrates. Air-fuel ratios and temperatures employed in the staged catalytic embodiment approach are generally described as being in the range of those used in conventional stationary and mobile gas turbines including aircraft gas turbines.

Space velocities are not critical and may be in the range of from 50,000 to 50,000,000, preferably from 500,000 to 5,000,000 V/V/Hr.

The third embodiment uses the novel primary zone combustion chamber and a catalyst is employed in the secondary zone. The catalyst is generally one of the types described for highest temperature catalytic combustion.

The materials which the primary zone combustion chamber may be constructed from include ceramics or high temperature alloys such as inconels and Hastelloys or other materials suitable for construction purposes. Temperatures of operation to be employed in the hybrid combustion approach are generally in the range of conventional gas turbine operations, and it is important to maintain air fuel ratios within the range of from 7 to 15, preferably from 10 to 14. The space velocities employed in the operation of the hybrid combustor approach are not crucial and are generally in the range of from 50,000 to 50,000,000, preferably from 500,000 to 5,000,000 V/V/Hr.

The operation of the gas turbine combustor in any of the above preferred embodiments results in the combustion of fuel to drive the turbine while at the same time $NO_x$ levels are maintained below about 10 ppm, preferably below about 5 ppm, most preferably below about 1 ppm.

The present invention and its embodiments may be more easily understood by reference to FIGS. 1–5 attached hereto and made a part of this application herewith. The basis for this invention can be explained with reference to FIG. 2 where the circled points refer to locations in the hybrid combustor system illustrated in FIG. 1. If the primary zone combustion occurs at about 70% stoichiometric air, then the equilibrium $NO_x$ emission index ($EI_{NOx}$) is 2.2 lb. per 1000 lb. fuel and the abiabatic flame temperature is 3850° F. Thus, a reasonable high temperature is achieved in zone 1 with a low $EI_{NOx}$. The dilution air would enter on the outside of the primary zone container at about 1000° F. and is illustrated as zone 2. The hot partially burned gas mixture would be diluted in zone 3 with the secondary air stream in such a manner as to avoid going through the stoichiometric combustion zone ($\phi - 1.0$). The mechanical design of the primary zone envelope is crucial to the proper operation of the hybrid combustor. The primary zone container can be made out of high temperature alloys such as Hastelloy X or ceramic. It should have small ports or chimneys to inject the primary zone gas rapidly into the air stream and also create local turbulence to mix the two streams rapidly. It has been shown that flame propagation would not occur if the quenching diameter (hole size) is kept below 0.12 inches or if the velocity of the hot gases leaving zone 1 is on the order of 100 feet/second. Alternatively, the primary zone envelope can be made out of a porous material like Rigimesh which would be effectively cooled by the outside air flow and at the same time allow the primary gas to flow to the outside. The resulting mixture, zone 4, would then go through the catalyst bed. Otherwise, a limited amount of oxidation would occur homogeneously and the desired turbine inlet temperature would be achieved. After zone 5 the effluent stream would be at an equivalence ratio of about 0.3 and at about 1700° F. for the indicated pressure and preheat temperature. In the case of automotive gas turbine combustion, the preheat temperature is much higher; therefore, the combustor effluent stream would approach temperatures of 2000° F. The process for $NO_x$ production is kinetically limited and therefore the actual $EI_{NOx}$ should be much lower than the 15 lb. per 1000 lb. fuel predicted at equilibrium. The efffect of "Prompt $NO_x$" would be higher in the case of rich primary comnbustion and can approach 10% of the equilibrium value, i.e., 0.22 lb. per 1000 lb. fuel. This prompt $NO_x$ value presents an expected value for the type of combustion proposed here (about 3 PPM).

The invention, having been described, will now be more fully understood by reference to the following examples which are intended to be illustrative and not limiting of the invention and its embodiments.

EXAMPLE 1

Figure 3:
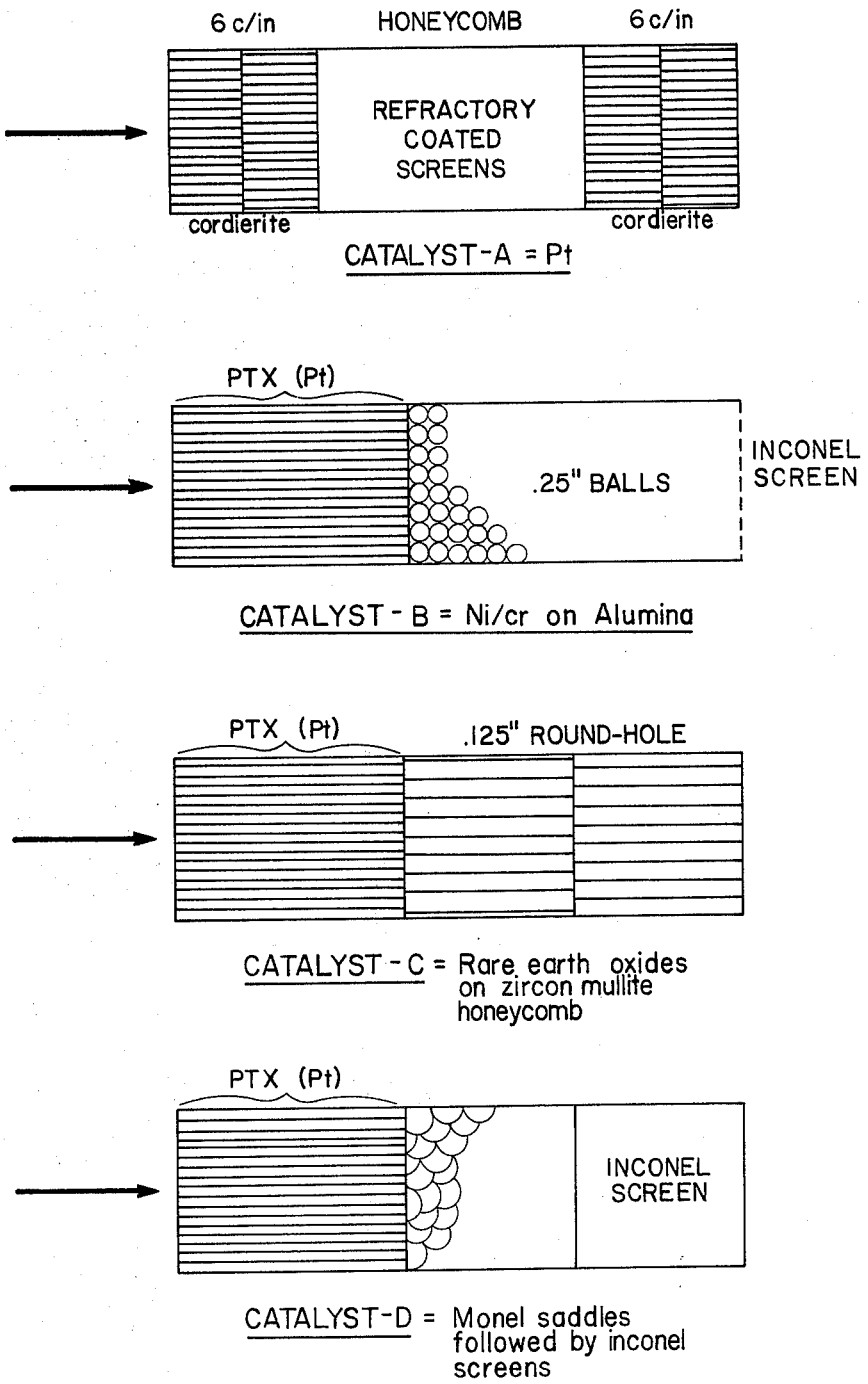
FIG. 3 is a schematic illustration of four catalyst systems useful in the operation of the present invention.
Figure 4:
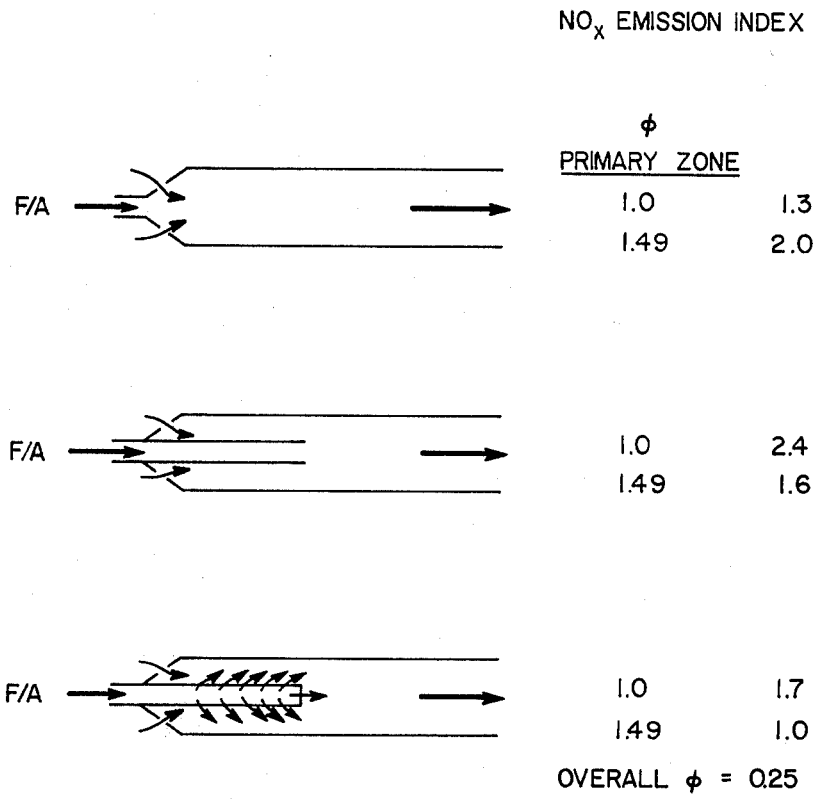
FIG. 4 is a schematic illustrating how the inventive hybrid system reduces $NO_x$ emissions.

In this example, the performance of the different catalyst systems described in this specification and illustrated in FIG. 3 were tested in gas turbine operations. The results of this testing are summarized in Table I and show a comparison of the inventive catalyst systems with a single catayst system tested by the U.S. Air Force (see Table I). It is noted that the single catalyst system was ineffective in obtaining "light-off" at temperatures as low as those used to test the catalyst systems of this invention. The single catalyst system would probably be a good approach for high power gas turbine operation but ineffective for low power operation and thus unsuitable by itself for gas turbines. It could, however, be used as the second or third catalyst in the systems described herein.

EXAMPLE 2

In this example, the hybrid combustion concept of this invention was tested. The experimental procedure employed a set up where part of the air was premixed with fuel in a commercial burner, and the rest of the air was mixed independently of the burner. The variables studied included percent stoichiometric air on the burner zone (primary zone), and different types of physical barriers between the primary zone and the dilution air. The overall percent stoichiometric air was kept constant at 400%. The results of these experiments are found summarized in Table II and/or shown schematically in FIG. 4.

The first set of experiments was run as control with no physical barrier between the primary zone and the dilution air. The results indicate that running the primary zone rich (67% stoichiometric air) increased $NO_x$ above that which was obtained from stoichiometric combustion.

A second set of experiments were run using an open ended tube to separate the primary zone from the dilution air. The results showed a 30% reduction on $NO_x$ being measured between hybrid type operation and stoichiometric or "conventional" operation.

Figure 1:
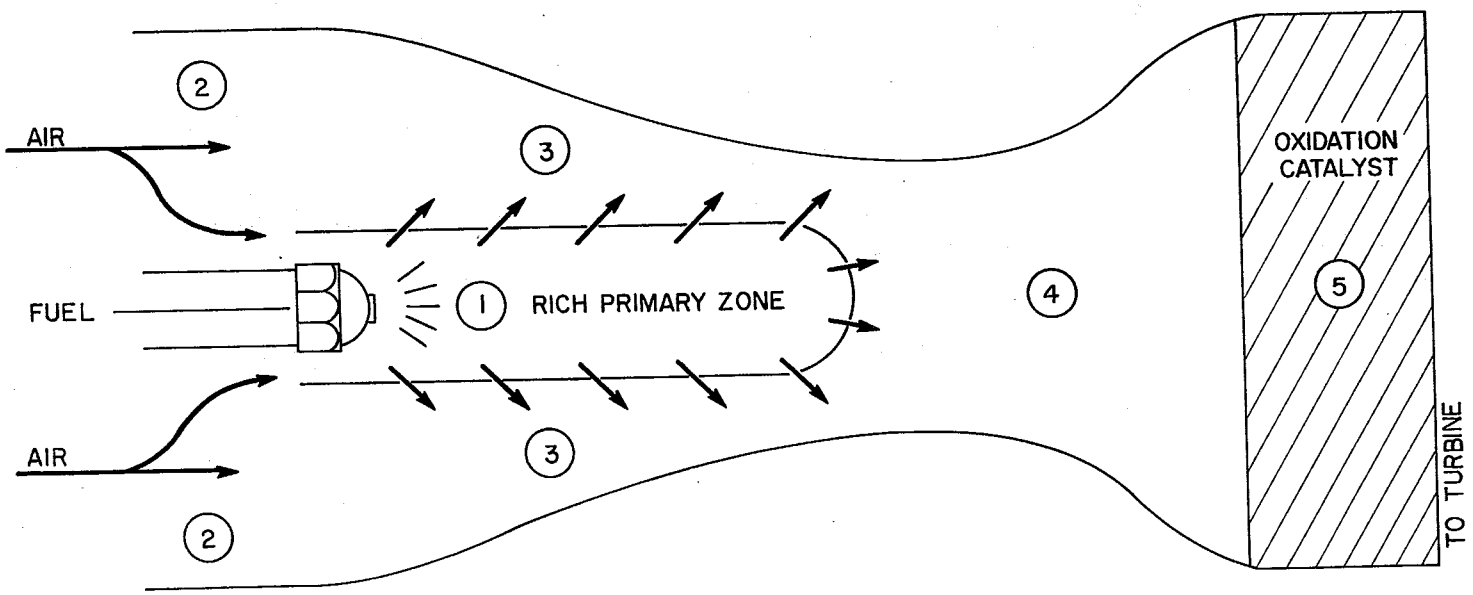
FIG. 1 depicts a schematic representation of a hybrid catalytic combustion process and shows the various combustion zones.
Figure 2:
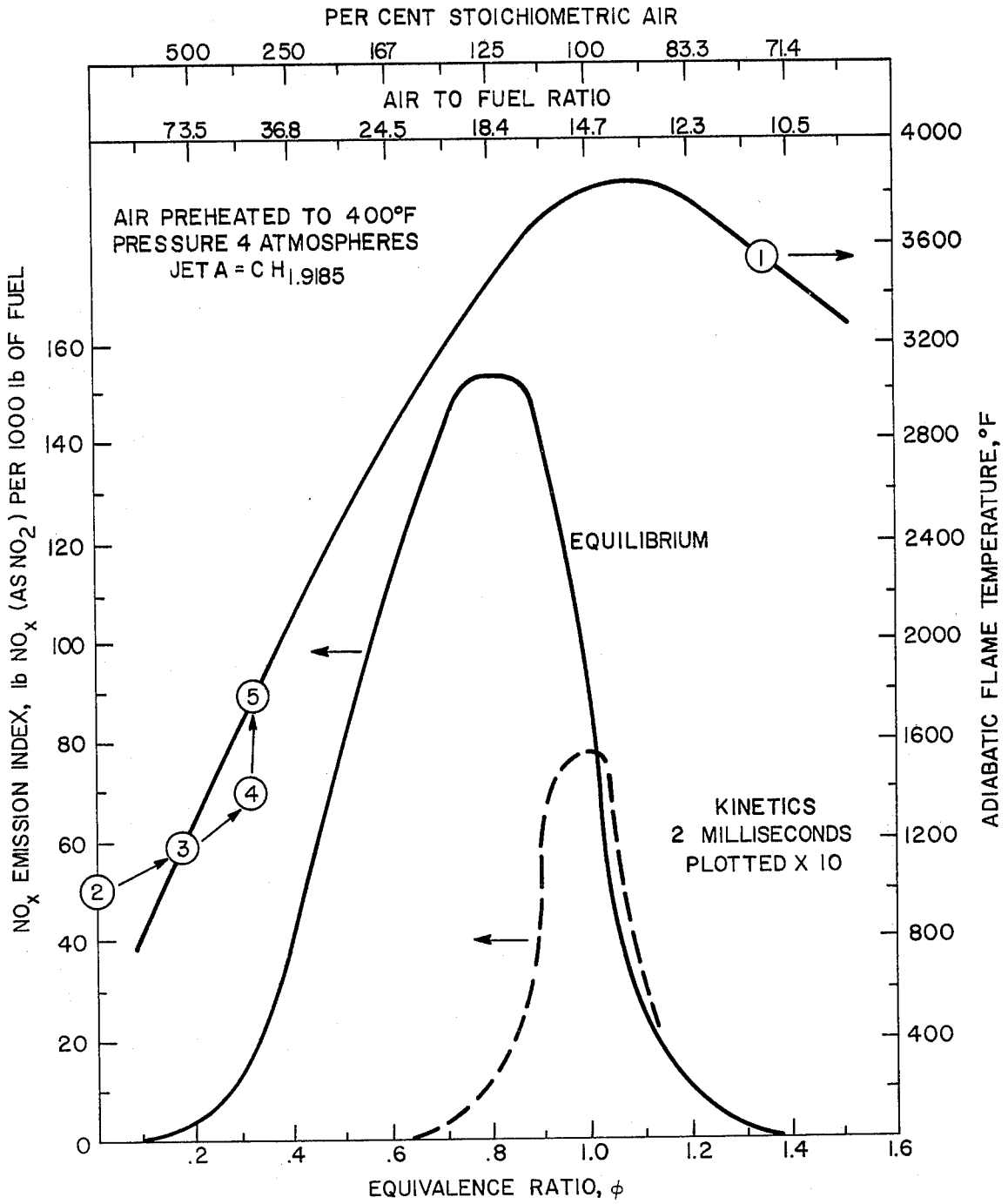
FIG. 2 is a graph illustrating air to fuel ratio and adiabatic flame temperatures for the various zones shown in FIG. 1 as (1), (2), (3), (4) and (5) plotted against a $NO_x$ emission index defined as pounds $NO_x$ (as $NO_2$) per 1000 pound of fuel.

In a third set of experiments a hybrid burner was used similar to that illustrated in FIG. 1. The hybrid burner was perforated with small holes and was made from Hastelloy X. An overall 40% reduction in $NO_x$ was measured between hybrid type operation and stoichiometric combustion.

This concept was demonstrated on a larger scale in a 3.08 cm (2 in.) cannular combustor using an open-ended perforated Hastelloy X can. Combustion air is split into primary air for fuel rich combustion, and secondary air for cooling the hybrid can as well as changing the stoichiometry of the fuel rich gaseous mixture to the lean side prior to impinging on the catalyst. The results of one of these experiments is given in Table III. It should be noted that better than 99% combustion efficiency is achieved by the hybrid preburner mode of operation. The centerline temperature going into the catalyst bed is 1153 K (1615° F.), well above the catalyst light-off temperature. The residual trace quantities of CO and unburned light hydrocarbons are easily oxidized over the catalyst to achieve on the order of 99.9% combustion efficiency. The quantity of $NO_x$ is equivalent to 2.2 g/kg of fuel or 0.11 lb./$10^6$ Btu which is below current environmental standards.

TABLE I

EXPERIMENTAL EVALUATION OF CATALYTIC COMBUSTION[1]

| | A | A | B | B | C | C | USAF[6] | | | D |
|---|---|---|---|---|---|---|---|---|---|---|
| Light-Off Temperature °F. | 400 | 400 | 400 | 400 | 400 | 400 | 710 | 615 | 540 | 400 |
| Light-Off $\phi$ | <0.21 | <0.16 | <0.14 | <0.23 | <0.1 | <0.1 | <0.22 | <0.22 | | 0.41 |
| CO | 1.2 | 6.2 | 1.0 | 5.0 | 1.3 | 2.0 | 900 | 900 | | |
| Unburned Hydrocarbons | 500 | 550 | 700 | 700 | 750 | 900 | 50 | 50 | | |
| Exit Temperature °F. | 630 | 800 | 600 | 800 | 550 | 550 | 1700 | 1950 | 2020 | 2200 |
| Space Velocity (STP)[2] | 261,000 | 523,000 | 261,000 | 523,000 | 261,000 | 523,000 | 820,000 | 820,000 | 820,000 | |
| Peak Exit Temperature $\phi$ | 0.50 | 0.50 | 0.60 | 0.60 | 0.60 | 0.60 | 0.44 | | | |

TABLE I-continued

| EXPERIMENTAL EVALUATION OF CATALYTIC COMBUSTION[1] | | | | | | | | | |
|---|---|---|---|---|---|---|---|---|---|
| | A | A | B | B | C | C | USAF[6] | | D |
| CO | 0.6 | 68. | 3.0[3] | 3.0 | 4.3[4] | 50 | 15 | | |
| Unburned Hydrocarbons | 340 | 340 | 100[3] | 400 | ~0.1[4] | 800 | | .35 | |
| Exit Temperature °F. | 2200 | 2200 | 2200 | 2000 | 2300 | 1700 | 2200 | 2300 | 2250 |
| Space Velocity (STP)[2] | 261,000 | 523,000 | 262,000 | 523,000 | 261,000 | 523,000 | 820,000 | 820,000 | 820,000 |

[1]$NO_x$ emissions were always lower than 4.5 ppm or 0.22 lb $NO_2$/1000 lb fuel
[2]Standard temperature and pressure are taken at 32°0 F. and 1 atmosphere, units are V/V/Hr.
[3]Estimated actual data at $\phi$ = 0.49 are CO = 20 lb/1000 lb fuel, unburned hydrocarbons = 250 lb (as $CH_4$)/1000 lb fuel 2nd exit temperature = 2000° F.
[4]Estimated actual data at $\phi$ = 0.55 are CO=25 lb/1000 lb fuel, unburned hydrocarbons = 10 lb (as $CH_4$)/1000 lb fuel 2nd exit temperature = 2000° F.
[5]Catalysts A-D are described in FIG. 3
[6]United States Air Force

TABLE II

| HYBRID SYSTEM EXPERIMENTS<br>Basis:<br>Propane Fuel<br>No preheat<br>Atm. pressure | | | |
|---|---|---|---|
| % Stoichiometric Air | | Can | lbs $NO_x$ |
| Primary Zone | Overall | Configuration | 1000 lbs fuel |
| 100 | 400 | None | 1.3 |
| 67 | 400 | None | 2.0 |
| 100 | 400 | Open Ended | 2.4 |
| 67 | 400 | Open Ended | 1.6 |
| 100 | 400 | Hybrid Type | 1.7 |
| 67 | 400 | Hybrid Type | 1.0 |

TABLE III

| EXPERIMENTAL VERIFICATION OF THE OPEN-ENDED HYBRID CATALYTIC COMBUSTOR | |
|---|---|
| Combustor Pressure (ATM) | 3.3 |
| Pri. & Sec. Air Preheat (K) | 400 |
| Primary Equivalence Ratio | 1.5 |
| Overall Equivalence Ratio | 0.3 |
| Reference Velocity (m/s)(1) | 24.4 |
| JP-4 Flow Rate (g/sec) | 2.718 |
| Primary Air Flow Rate (g/s) | 26.66 |
| Secondary Air Flow Rate (g/s) | 106.61 |
| Pri. Injector Velocity (m/s) | 65.6 |
| Sec. Air Vel. Around Pre-burner (m/s) | 70 |
| Sec. Air Inj. Vel. @ Pre-burner Discharge (m/s)(2) | 19.5 |
| **Temp. Profile at Catalyst Bed Inlet (K)** | |
| Thermocouple (C) | 924 |
| Thermocouple (D) | 1083 |
| Thermocouple (E) | 1153 |
| Thermocouple (F) | 1143 |

TABLE III-continued

| EXPERIMENTAL VERIFICATION OF THE OPEN-ENDED HYBRID CATALYTIC COMBUSTOR | | | | | |
|---|---|---|---|---|---|
| | Concentration Profile at Catalyst Bed Inlet | | | | |
| | CO PPM | $CO_2$ % | $O_2$ % | $NO_x$ PPM | HC PPM |
| Probe (C) | 395 | 4.5 | 14.4 | 32 | 50 |
| Probe (D) | 345 | 4.5 | 14.4 | 33 | 70 |
| Probe (E) | 350 | 4.6 | 14.8 | 26 | 120 |
| Probe (F) | 365 | 4.2 | 14.6 | 29 | 48 |

(1)Calculated for air preheat of 400K (260° F.) in 5.08 cm (2.0 in) diameter catalyst chamber.
(2)No heat addition except for 400K preheat.

What is claimed is:

1. A method for combusting fuels in a gas turbine which comprises:

(a) partially combusting fuel with air within an open cannular combustor located within a primary, non-catalytic section of the combustor of said gas turbine to form a hot, partially burned effluent which emanates from an opening in said cannular combustor, the amount of air present within said cannular combustor varying from 50 to 70% of the stoichiometric requirements for complete combustion of said fuel;

(b) quenching said hot, partially burned effluent with additional air within said combustor without continued high temperature combustion, the amount of such additional air being sufficient to support the subsequent combustion of the partially burned fuel contained in said effluent; and (c) passing said quenched effluent over an oxidation catalyst at a temperature above the catalyst light-off temperature to complete the combustion of said fuel.

2. The method of claim 1 wherein said open cannular combustor is a perforated cannular combustor.

* * * * *